US008579619B2

(12) United States Patent
Schepp et al.

(10) Patent No.: US 8,579,619 B2
(45) Date of Patent: Nov. 12, 2013

(54) INTERNAL GEAR PUMP FOR A BRAKE SYSTEM

(75) Inventors: Rene Schepp, Waiblingen (DE); Norbert Alaze, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 426 days.

(21) Appl. No.: 12/739,609

(22) PCT Filed: Sep. 22, 2008

(86) PCT No.: PCT/EP2008/062596

§ 371 (c)(1),
(2), (4) Date: Apr. 23, 2010

(87) PCT Pub. No.: WO2009/053188

PCT Pub. Date: Apr. 30, 2009

(65) Prior Publication Data

US 2010/0233005 A1 Sep. 16, 2010

(30) Foreign Application Priority Data

Oct. 24, 2007 (DE) ..... 10 2007 050 820

(51) Int. Cl.
*F01C 1/10* (2006.01)

(52) U.S. Cl.
USPC ..... 418/170; 418/179; 418/152

(58) Field of Classification Search
USPC ..... 418/170, 179, 152, 153, 156
See application file for complete search history.

(56) References Cited

U.S. PATENT DOCUMENTS 2,482,713 A * 9/1949 Jones ..... 418/126
3,907,470 A * 9/1975 Harle et al. ..... 418/170

* cited by examiner

*Primary Examiner* — Zelalem Eshete
(74) *Attorney, Agent, or Firm* — Maginot, Moore & Beck

(57) ABSTRACT

The invention relates to an internal gear pump for a braking system, in the pump housing of which an inner toothed hollow wheel and a gearwheel engaging in the toothing of the hollow wheel are mounted to rotate about parallel axes. The toothing thereof defines a tapering roughly crescent-shaped pump chamber, in which a filling piece is arranged supported along the length thereof. The circumferential surfaces of the filling piece closely correspond to the head diameter of the inner toothing of the hollow wheel or the gearwheel toothing and contact in a sealing manner with several tooth crowns covered thereby. A radial supporting force acts over a longitudinal range of the filling piece for improved sealing of a circumferential surface of the filling piece against the tooth crowns supporting the circumferential surface. According to the invention, a loose fit is provided between the circumferential surfaces of the filling piece and the opposing tooth crowns of the hollow wheel and gearwheel and the play acting on the filling piece is partly eliminated by support forces acting in opposing radial directions which act on the filling piece at a distance from each other.

17 Claims, 1 Drawing Sheet

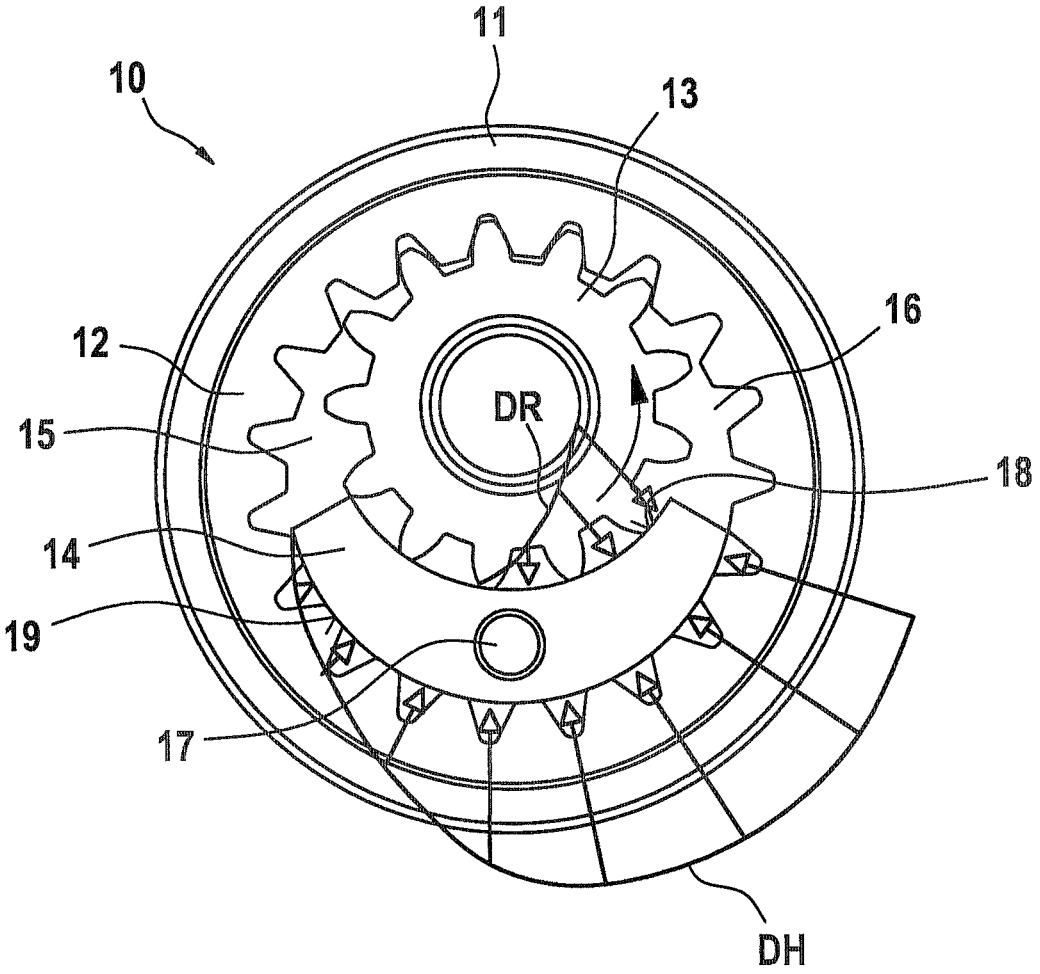
10
11
13
12
16
15
DR
18
14
19
17
DH

INTERNAL GEAR PUMP FOR A BRAKE SYSTEM

CROSS-REFERENCE TO RELATED APPLICATION

This application is a 35 USC 371 application of PCT/EP2008/062596 filed on Sep. 22, 2008.

BACKGROUND OF THE INVENTION

1. Field of the Invention

The invention is based on an internal gear pump for a brake system of the kind used particularly in the hydraulic system of vehicle brake systems.

2. Description of the Prior Art

One such internal gear pump has already been disclosed for instance in German Patent Disclosure DE 19613833 B4. There the fluid is pumped in the usual way from the intake side to the pressure side of the internal gear pump in that a filler piece, tapering toward the pressure side, is disposed in a crescent-shaped annular chamber of the pump between the internal geared wheel and the pinion and which is braced by one end axially against the fluid pressure on the pressure side on a stop face. The filler piece rests with its curved inner and outer circumferential face, with radial sealing, at a plurality of tips of teeth of the pinion and of the internal geared wheel, respectively. Since the fluid volumes entrained by the sealed-off gaps between teeth of the gear wheels rotating in the same direction are brought together at the tapered end of the filler piece, the desired high pressure level results in this region of the pump. In order to attain the most effective possible sealing off of the tooth gaps in the region of the tips of teeth, the filler piece is composed of a segment holder, forming the base part, and a sealing segment that is braced movably on the segment holder; the circumferential face of the segment holder rests on the covered tips of teeth of the pinion, and the opposed circumferential face of the sealing segment rests on the covered tips of teeth of the internal geared wheel. A leaf spring arrangement with three leaf springs is also braced between the segment holder and the sealing segment and by means of it, the segment holder and sealing segment are pressed apart and thus rest with spring loading on the covered tips of teeth. In addition, the segment holder and sealing segment, under corresponding operating conditions, are pressed apart by way of a fluid pressure, equivalent to approximately half the operating pressure, since an intermediate chamber partitioned off by elastic sealing rollers of an elastomer or polymer material, located between the segment holder and the sealing segment, communicates fluidically through recesses with a pressure buildup region of the internal geared wheel. The sealing rollers engage an associated groove and must be kept in their sealing position by means of one at a time of the three leaf springs during the shifting of the sealing segment. Thus the sealing between the covered tips of teeth and the circumferential side, cooperating with them, of the segment holder and the sealing segment remains automatically operative as the pressure level of the pump increases as a consequence of an increase in the contact pressure. The geared pump is technically very complicated, especially because the filler piece is composed of many parts and the production of the internal gear pump is correspondingly expensive.

ADVANTAGES AND SUMMARY OF THE INVENTION

The internal gear pump of the invention has the advantage over the prior art that it can be designed technically more simply and as a result can be produced less expensively. The demands for dimensional stability of the filler piece are already less because an essentially form-locking and thus sealing fitting in of the filler piece into the crescent-shaped pump chamber between the internal geared wheel and the pinion, which is the goal in geared pumps, is not provided; instead, intentionally some circumferential play of the filler piece is created relative to the tip circles of the corresponding sets of teeth. Because of this "clearance fit", relatively generous tolerance ranges can be selected for the filler piece, which has a positive effect on production costs for it. The most play-free possible contact of the circumferential faces of the filler piece with the covered tips of teeth of the internal geared wheel and pinion, which is necessary to avoid pressure-lowering leakage losses from the internal gear pump, is attained only by way of the supporting forces acting with longitudinal spacing in opposite radial directions on the filler piece. The regions of the filler piece circumference that are in contact without play are also relatively short. In principle, to generate the freedom from play two spring forces, for instance, could engage opposed circumferential sides of the filler piece accordingly, and could press the filler piece onto the toothing of the internal geared wheel on the one hand and onto the toothing of the pinion on the other.

Especially advantageously, the filler piece is designed as a two-armed lever, supported in rockerlike fashion in its middle region, whose end regions as a result of tilt shifting of the filler piece can be brought without play into contact with the toothing of the internal geared wheel on the one hand and the toothing of the pinion on the other. By the disposition of the filler piece in between the toothing, the supporting forces engaging the filler piece at longitudinal spacing from one another can be introduced centrally into the two-armed lever, and its end regions can be pressed down onto the associated toothing. Consequently, for generating the supporting load for the tilt shifting, now only a single element, such as a load spring, is necessary.

For the tilt shifting of the filler piece, a rotary support via a pivot shaft is technically especially appropriate, since by that means, a defined control of the motion of the filler piece that can be replicated highly precisely becomes possible. Moreover, a sufficiently exact rotary support can be generated via a pivot shaft, formed by an axial bolt or the like in a technically simple way and can at the same time serve to brace the filler piece longitudinally of the crescent-shaped pump chamber. This dual function of the rotary support leads to an overall simpler construction of the internal gear pump.

If the contact pressure of the filler piece ends on the associated tips of teeth is supposed to be of equal magnitude in opposite directions, the filler piece is preferably designed mirror-symmetrically, and the axis of the mirror coincides with the axis of rotation. As a result, the suitability of the internal gear pump for directionally reversible pump operation is furthermore improved. For the sake of that suitability, it is also practical if the pivot shaft of the filler piece is disposed centrally—that is, in the region of greatest eccentricity—in the pump chamber of the internal gear pump.

In the ideal case, the filler piece is embodied in one piece, possibly with the exception of the pivot shaft that supports it, and in addition, a load spring for the pivoting drive of the filler piece can be provided in any case. By technical skillful disposition and design of the filler piece in the pump chamber of the internal gear pump, a pressure difference of the fluid between the inner circumference and outer circumference of the filler piece can even be exploited in order to exert the requisite pivoting force on the filler piece. The result is a further substantial simplification in pump construction.

Achieving the pressure difference for generating the pivoting force on the filler piece is facilitated if the end of the filler piece located on the pressure side of the internal gear pump is provided with an approximately radially extending face end.

On account of the functional principle of the subject of the invention, the play-free contact of the filler piece is limited to a relatively short circumferential portion. Particularly in pumps operating at high operating pressure, it is therefore important that to avoid an overly steep pressure drop, a sufficient number of tips of teeth on the toothing of the internal geared wheel are covered by the outer circumference of the filler piece. This is easily possible if the outer circumference of the filler piece covers approximately half of the tips of teeth of the internal geared wheel that are in engagement with the pinion.

Especially with a mirror-symmetrical design of the internal gear pump, its pump direction can easily be reversed by reversing the direction of rotation of the drive motor and thus of the pinion. The pump output can remain the same without structural changes to the internal gear pump, at least if the inlet and outlet openings of the internal gear pump have a through cross section of the same size.

BRIEF DESCRIPTION OF THE DRAWINGS

The invention will be described in further detail below in conjunction with the accompanying drawings, in which:

FIG. 1 shows the interior of an internal gear pump according to the invention, with an associated filler piece arrangement, in a side view.

DESCRIPTION OF THE PREFERRED EMBODIMENT

An internal gear pump 10, shown in FIG. 1, for a hydraulic system of a brake system includes as its primary components an internal geared wheel 12, which is supported rotatably in a slide bearing of a pump housing 11 and has an internal toothing with which a corresponding counterpart toothing of a pinion 13, supported rotatably eccentrically to the internal geared wheel 12 in the pump housing 11, meshes. The internal toothing of the internal geared wheel 12, in the exemplary embodiment shown, has nineteen teeth, and the outer toothing of the pinion 13 has thirteen teeth. Of the pinion 13, approximately four teeth engage corresponding tooth gaps of the upper toothed region of the internal geared wheel 12, since the axes of rotation of the pinion 13 and internal geared wheel 12 are both located in a vertical plane of the internal gear pump 10. Adjoining the engagement region of the pinion 13, the tip circles of the internal geared wheel 12 and pinion 13 define a crescent-shaped pump chamber, in the lower half of which a crescent-shaped filler piece 14, adapted essentially to the circumferential contour of that chamber, is disposed. The filler piece 14 has the task of sealing off the tooth gaps covered by it, which are sealed off axially on both sides by the face ends of the pump housing 11 or pressure plates disposed on it, by means of contact with tips of teeth in the region of its tip circle. The filler piece 14 is supported rotatably centrally in the crescent-shaped pump chamber via a pivot shaft 17 formed by an axial bolt, and the geometric axis of rotation of the pivot shaft 17 is likewise in the vertical plane of the axes of rotation of the pinion 13 and internal geared wheel 12, and the filler piece 14 is designed mirror-symmetrically with respect to the vertical plane. With its upper and inner circumferential faces, the filler piece 14 extends along the tip circle of the pinion 13 and in this case simultaneously covers a maximum of five tips of teeth and four tooth gaps of the pinion toothing. The lower or outer circumferential face of the filler piece 14 by comparison extends along the tip circle of the toothing of the internal geared wheel 12, and a maximum of eight tips of teeth and eight tooth gaps of the internal geared wheel toothing are covered. The two ends of the filler piece 14 are cut off straight and form plane face ends, corresponding to the cross section in the tapered end region, that each extend radially to the axis of rotation of the pinion 13.

If the pinion 13, with sealed-off tooth gaps, is rotated counter-clockwise, as indicated by a curved arrow, for instance by means of an electric motor, then the internal geared wheel 12 is rotated with it in the same direction because of the toothing engagement. The hydraulic fluid in the internal gear pump 10 is pumped in the process into the tooth gaps of the internal geared wheel 12 and pinion 13 from the intake region 15 to the pressure region 16 of the internal gear pump 10. The intake region 15 is accordingly located in the left half of the pump housing 11, in terms of the direction of rotation shown, and the pressure region 16 is located in the right half of the pump housing 11. The pressure increase in the hydraulic fluid occurs with joint rotation of the internal geared wheel 12 and the pinion 13 by means of uniting the fluid volumes, entrained by the toothing of the internal geared wheel and pinion in the tooth gaps, on the tapered end of the filler piece 14 in the pressure region 16 in conjunction with the overflow blockage between the intake region 15 and pressure region 16 of the internal gear pump 10 by means of the filler piece 14. Thus the sealing off between the filler piece 14 and the tips of teeth covered by it is of decisive significance for the pressure level of the fluid that is to be built up in the hydraulic system by the internal gear pump 10.

As can be seen only indirectly in the drawing, the circumferential faces of the filler piece 14 do not contact all the covered tips of teeth of the internal geared wheel toothing or pinion toothing; instead, the filler piece 14 is inserted into the crescent-shaped pump chamber with slight circumferential play. The circumferential play of the filler piece 14 is intentionally undone by urging the filler piece 14 to rotate counter-clockwise about the pivot shaft 17 in a contact region 18 on its inner circumferential face and in a contact region 19 on the outer circumferential face. The two contact regions 18 and 19 are located on opposite end regions of the filler piece 14, since because of the rotary loading, forcing or canting of the filler piece 14 occurs between the sets of teeth of the internal geared wheel 12 and of the pinion 13.

If the play imposed on the filler piece 14 and the dimensioning of the filler piece and its disposition are adapted to one another, for instance in the manner shown, then the rotary force necessary for eliminating the circumferential play of the filler piece 14 is obtained from the pressure conditions in the interior of the internal gear pump 10 itself. In operation of the internal gear pump 10, a pressure field DH is operative between the outer circumferential face of the filler piece 14 and the opposed toothing of the internal geared wheel 12, and a pressure field DR is simultaneously operative between the inner circumferential face of the filler piece 14 and the opposed toothing of the pinion 13.

As can be seen from the pressure field DH shown, the pressure course, represented by different lengths of arrows, between the pressure region 16 and the intake region 15 initially remains virtually constant up to the pivot shaft 17 of the filler piece 14, and after that drops steeply off toward the end of the filler piece 14 in the intake region 15. This pressure course is due to the fact that the play imposed increases in the clockwise direction, but the sealing relative to the tips of teeth is not sufficiently operative to enable limiting the leakage losses to a minimum until in the left half of the filler piece 14. Because of this pressure course, the filler piece 14 is urged to rotate with considerable force in the counter-clockwise direction about the pivot shaft 17, as a result of which the inner circumferential face of the filler piece 14 in the contact region 18 is pressed with great force against the corresponding tip of a tooth of the pinion 13.

This contact pressure acts counter to a pressure field DR that is build up between the toothing of the pinion 13 and the filler piece 14. Because of the high contact pressure, the sealing between the filler piece 14 and the pinion toothing directly adjacent to the pressure region 16 is sufficiently effective to enable limiting the leakage losses to a minimum. Thus from the very outset in the pressure field DR, there is a steep pressure drop, which is reduced in the middle region of the filler piece 14 to nearly the pressure level of the intake region 15.

Since with regard to its vertical center plane the internal gear pump 10 is embodied mirror-symmetrically, the pump direction can be reversed without structural changes, by reversing the direction of rotation of the drive motor. This would result in a corresponding transposition of the pressure fields DR and DH, along with urging the filler piece 14 to rotate clockwise and shifting of the play-free contact regions 18 and 19 toward the opposite end region of the circumferential face of the filler piece 14. If because of the strong frictional forces excessive wear occurs in the contact regions 18 and 19, the internal gear pump 10 can thus, after a change of the direction of rotation, be operated further without problems, without having to replace any parts.

Since the internal gear pump 10 described has only a few components and has a simple filler piece 14, it is distinguished by an overall simple, sturdy construction. It can accordingly be produced inexpensively, and a long service life can be expected with good characteristic pump values.

The foregoing relates to the preferred exemplary embodiment of the invention, it being understood that other variants and embodiments thereof are possible within the spirit and scope of the invention, the latter being defined by the appended claims.

The invention claimed is:

1. An internal gear pump for a brake system comprising:

a pump housing;

an internally toothed internal geared wheel supported in the pump housing and having internal teeth;

a pinion supported in the pump housing and having pinion teeth that mesh with the internal teeth of the internal geared wheel; and a longitudinally braced filler piece, wherein the internal geared wheel and the pinion are supported rotatably about parallel axes, as a result of which the internal teeth and the pinion teeth define a pump chamber which tapers in approximately crescent-shaped form and in which the longitudinally braced filler piece is disposed, wherein the longitudinally braced filler piece includes circumferential faces that are curved virtually correspondingly to a tip circle of the internal teeth of the internal geared wheel or of the pinion teeth, and the circumferential faces rest sealingly on a plurality of tips of teeth covered by the circumferential faces, wherein over a longitudinal region of the filler piece, a radial supporting force operates to seal off a circumferential face of the filler piece from tips of teeth bracing the circumferential face, wherein a clearance fit is defined between the circumferential faces of the filler piece and opposed tips of the internal teeth and of the pinion teeth so that a play is imposed on the filler piece, wherein the play is eliminated in some regions of the filler piece by supporting forces acting on the filler piece in opposite radial directions at a spacing from one another, and wherein the filler piece is a two-armed lever, supported pivotably and fixed translationally in a middle region of the two-armed lever, and the filler piece pivots between the internal geared wheel and the pinion to force regions of the filler piece into contact with the tips of the internal teeth and the pinion teeth.

2. The internal gear pump as defined by claim 1, wherein the filler piece is supported rotatably in the pump housing about a pivot shaft.

3. The internal gear pump as defined by claim 1, wherein the filler piece is embodied minor-symmetrically with respect to a pivot shaft.

4. The internal gear pump as defined by claim 2, wherein the filler piece is embodied minor-symmetrically with respect to the pivot shaft.

5. The internal gear pump as defined by claim 2, wherein the pivot shaft of the filler piece is disposed centrally in the crescent-shaped pump chamber between the internal geared wheel and the pinion.

6. The internal gear pump as defined by claim 4, wherein the pivot shaft of the filler piece is disposed centrally in the crescent-shaped pump chamber between the internal geared wheel and the pinion.

7. The internal gear pump as defined by claim 2, wherein the filler piece is embodied in one piece.

8. The internal gear pump as defined by claim 4, wherein the filler piece is embodied in one piece.

9. The internal gear pump as defined by claim 2, wherein a pressure difference between the circumferential faces of the filler piece at an end region of the filler piece oriented toward a pressure region of the internal gear pump urges the filler piece to pivot.

10. The internal gear pump as defined by claim 4, wherein a pressure difference between the circumferential faces of the filler piece at an end region of the filler piece oriented toward a pressure region of the internal gear pump urges the filler piece to pivot.

11. The internal gear pump as defined by claim 1, wherein an end of the filler piece oriented toward a pressure region of the internal gear pump has an approximately radially extending face end.

12. The internal gear pump as defined by claim 1, wherein the filler piece extends longitudinally over approximately half of a length of the crescent-shaped pump chamber of the internal gear pump.

13. The internal gear pump as defined by claim 1, wherein the internal gear pump is driven directionally reversibly.

14. The internal gear pump as defined by claim 1, wherein:

the filler piece has a first end region and a second opposite end region, the circumferential faces of the filler piece include a concave inner circumferential surface that faces toward the pinion and a convex outer circumferential surface that faces away from the pinion, and during operation of the internal gear pump, the inner circumferential surface contacts the pinion teeth in the first end region and the play is imposed between the inner circumferential surface and the pinion teeth in the second end region.

15. The internal gear pump as defined by claim 14, wherein during operation of the internal gear pump, the outer circumferential surface of the filler piece contacts the internal teeth in the second end region and the play is further imposed between the outer circumferential surface and the internal teeth in the first end region.

16. An internal gear pump for a brake system comprising:

a pump housing;

an internally toothed internal geared wheel supported in the pump housing and having internal teeth;

a pinion supported in the pump housing and having pinion teeth that mesh with the internal teeth of the internal geared wheel; and a longitudinally braced filler piece, wherein the internal geared wheel and the pinion are supported rotatably about parallel axes so that the internal teeth and the pinion teeth define a pump chamber which tapers in approximately crescent-shaped form and in which the longitudinally braced filler piece is disposed, wherein the filler piece includes a first end region, an opposite second end region, a concave inner circumferential surface that faces toward the pinion, and a convex outer circumferential surface that faces away from the pinion, wherein a clearance fit is defined between the circumferential surfaces of the filler piece and opposed tips of the internal teeth and of the pinion teeth so that a play is imposed on the filler piece, wherein the filler piece is a two-armed lever that is fixed translationally and supported pivotably in a middle region of the two-armed lever, and wherein during operation of the internal gear pump, the inner circumferential surface of the filler piece contacts the pinion teeth in the first end region and the play is imposed between the inner circumferential surface and the pinion teeth in the second end region.

17. The internal gear pump as defined by claim 16, wherein during operation of the internal gear pump, the outer circumferential surface of the filler piece contacts the internal teeth in the second end region and the play is further imposed between the outer circumferential surface and the internal teeth in the first end region.

* * * * *

UNITED STATES PATENT AND TRADEMARK OFFICE

CERTIFICATE OF CORRECTION

PATENT NO. : 8,579,619 B2
APPLICATION NO. : 12/739609
DATED : November 12, 2013
INVENTOR(S) : Schepp et al.

It is certified that error appears in the above-identified patent and that said Letters Patent is hereby corrected as shown below:

In the Claims

In column 6, lines 18-23, claims 3 and 4 should read as follows:

3. The internal gear pump as defined by claim 1, wherein the filler piece is embodied mirror-symmetrically with respect to the pivot shaft.

4. The internal gear pump as defined by claim 2, wherein the filler piece is embodied mirror-symmetrically with respect to the pivot shaft.

Signed and Sealed this
Thirtieth Day of December, 2014

Michelle K. Lee

Michelle K. Lee
*Deputy Director of the United States Patent and Trademark Office*